United States Patent [19]

Schmale

[11] Patent Number: 4,546,878

[45] Date of Patent: Oct. 15, 1985

[54] BAND OF LATCH ASSEMBLIES

[75] Inventor: Karl-Ernst Schmale, Lüdenscheid, Fed. Rep. of Germany

[73] Assignee: Schmale GmbH & Co., KG, Lüdenscheid, Fed. Rep. of Germany

[21] Appl. No.: 470,283

[22] Filed: Feb. 28, 1983

[30] Foreign Application Priority Data

Feb. 27, 1982 [DE] Fed. Rep. of Germany ... 8205544[U]

[51] Int. Cl.[4] ..... B65D 69/00; B27F 7/00

[52] U.S. Cl. ..... 206/343; 206/338; 206/820; 292/285

[58] Field of Search ..... 24/17 R, 30.5 R, 241 P, 24/265 A; 206/338–348, 820, 830; 292/285, 286

[56] References Cited

U.S. PATENT DOCUMENTS

| | | | |
|---|---|---|---|
| 1,080,551 | 12/1913 | Hartwell | 220/324 |
| 1,276,852 | 8/1918 | Altenberg | 220/324 |
| 3,147,086 | 9/1964 | Batcheller et al. | 206/820 |
| 3,588,792 | 6/1971 | Kindell et al. | 206/343 |
| 3,774,756 | 11/1973 | Carlile et al. | 206/348 |
| 3,905,745 | 9/1975 | Pritulsky et al. | 206/820 |
| 4,403,694 | 9/1983 | Schmale | 206/347 |

FOREIGN PATENT DOCUMENTS

| | | |
|---|---|---|
| 7623139 | 11/1976 | Fed. Rep. of Germany . |
| 2405998 | 10/1981 | Fed. Rep. of Germany . |
| 2422128 | 12/1981 | Fed. Rep. of Germany . |
| 2904503 | 12/1981 | Fed. Rep. of Germany . |
| 1910580 | 5/1982 | Fed. Rep. of Germany . |

*Primary Examiner*—George E. Lowrance
*Assistant Examiner*—Jimmy G. Foster
*Attorney, Agent, or Firm*—Spencer & Frank

[57] ABSTRACT

A band of assemblies is provided for use with a fitting machine which attaches each assembly to a respective article. The band includes a common elongated coupling strip and a plurality of assemblies. Each assembly includes a cap-shaped attachment member. The attachment member includes a fastening element for attaching the attachment member to an article and each assembly is connected to the coupling strip by a respective one of the attachment members.

12 Claims, 6 Drawing Figures

BAND OF LATCH ASSEMBLIES

BACKGROUND OF THE INVENTION

The present invention relates to a band including a coupling strip and latch assemblies (hasps) connected to the coupling strip; each latch assembly may have first or upper and second or lower latch parts. The band can be fed to a fitting machine for applying the latch assemblies to boxes, containers, cases or other articles.

Bands of the above-mentioned type are known. They serve to simplify the supply and application of latch assemblies to box-shaped containers, such as crates, boxes, cases made of wood, paper, plastic or the like. Using a coupling strip in the mounting of latch assemblies on articles is advantageous since a separate application or individual insertion of each latch assembly into the fitting machine is not necessary; instead, a band-like supply, for example, a roll, may be fed to the fitting machine. In the fitting machine, the latch assemblies are separated from the coupling strip and are affixed, for example, by hammering, to a container. Each latch part of each latch assembly is generally provided with an attachment portion having, for example, pointed prongs which can be hammered into the article. The band-like supply of latch assemblies simplifies the fitting machine as well as the fitting process because the need for collection and alignment of individual latch assembly parts before introduction into the fitting machine and before the fitting process is eliminated.

German Pat. No. 1,910,580 discloses a known band-like supply of latch assemblies in which each attachment portion of each latch assembly is formed by an attachment plate which is integral with the coupling strip and lies in the same plane therewith. The attachment plate for the upper latch part of each latch assembly has a pivotal, apertured flap articulated thereto. The attachment plate for the lower latch part of each latch assembly is equipped with a button. In service, that is, after the hasp has been mounted on the article, such as a box with a hinging lid, the hasp can be closed by pivoting the flap onto the button, so that the opening in the flap passes over the button to fasten together the upper and lower latch parts.

In a further, known band of the above type disclosed in German Pat. No. 2,405,998, a hinge provided between the attachment plate and the flap of the upper latch part includes a relatively weak leaf spring stamped out of the upper latch part.

In another known band of the above type disclosed in German Pat. No. 2,422,128, an attachment plate serves as a mounting plate having coupling portions permitting a latching engagement with one of the latch members. The coupling may be bars projecting from the plane of the attachment plate as disclosed in German Offenlegungsschrift (Application Published without Examination) No. P 2,904,503.

All known bands of latch assemblies (hasps) include attachment plates by which each latch part is attached to the respective article part. Latches are known, however, such as those described in German Utility Model Patent No. 7,623,139, in which the attachment member is not an attachment plate, but an attachment cap, that is, a housing-like member which has distinct dimensions not only in length and width but also in height. Such housing-like attachment caps have previously not been combined with a coupling strip to form a band of latch assemblies. The expenditures considered to be necessary to accomplish this have in the past appeared excessive. Moreover, the stability of the coupling strip itself and of the connections between the latch parts and the coupling strip were considered to be insufficient.

SUMMARY OF THE INVENTION

It is an object of the present invention to combine a latch assembly having cap-like attachment members with a coupling strip.

The above and other objects are accomplished according to the invention in which a band of latch assemblies is provided for use with a fitting machine which attaches each assembly to a respective article. The band includes a common elongated coupling strip and a plurlity of latch assemblies. Each assembly includes a cap-shaped attachment member having fastening means for attaching the attachment member to an article and each assembly is connected to the coupling strip by a respective one of the cap-shaped attachment members.

According to a further feature of the invention, the cap-shaped attachment members each have at least one wall which is shaped partly at an angle and which is integral with the coupling strip. In the simplest embodiment of the invention, only part of one of the walls of the cap is angled and connected with the coupling strip. This saves material and reduces the cutting pressures in the fitting machine since the surfaces to be cut off are kept small. Any wall of the cap can be used to form the connection with the coupling strip. Since, however, in case of the side walls, in addition to bending, it is necessary to twist them at an angle so they are parallel with the coupling strip, the bottom wall or the front wall of the cap is used with preference. At least one tongue is cut out of the bottom wall of the cap, or the front wall of the cap is extended beyond the bottom wall to form at least one tongue. The tongue is then angled and merged into a connecting web affixed to the coupling strip. If a single tongue is used, it is advantageously provided in the axis of symmetry of upper and lower latch parts of the latch assembly, situated at either side of the coupling strip. After the machine process of fitting the latch parts on an article, such as a container, the tongue remains integral with the cap of, for example, the upper latch part, and may be guided into an opening in the bottom of the lower latch part.

The caps may be arranged at the same side of the coupling strip. If two different caps are to be combined into one article, as is the case, for example, with a latch assembly, the mating members are advantageously accommodated at the same height on opposite sides of the coupling strip. Offset connections of cap members in the longitudinal direction of the coupling strip is also possible. Moreover, an attachment member in the form of a cap also can be combined with a conventional, plate-shaped attachment member.

The present invention makes it possible to fasten caps of different design to one coupling strip. Under consideration here are cap-shaped configurations having fastening elements with and without apertures, caps forming housings to accommodate spring mechanisms, latch mechanisms, locks and the like. The cap-shaped member may be used as a mounting member for an articulated connection, such as a hinge or for a handle, for example, a handle plate or for a floor slide or castor or for a decorative element. Moreover, two cap-shaped members may be mounted on top of one another and aligning elements may be provided at the upper and lower multi-cap attachment members, respectively. Different fastening elements for affixing the attachment members to a container, box, case, etc., such as pointed tips, clamps, screws, nails, may be provided on the lower cap member or on both cap members.

In a further embodiment of the invention, the connection between cap and coupling strip is angled or bent one time. The connection may extend in the plane of the upper edge, the center region or the lower edge of the cap, or in the region of an aligning element. Alternatively, the connection between cap and coupling strip may be angled more than once. It is further possible to provide connections between the caps and the coupling strip in planes at different heights.

According to a further feature of the invention, the connection between cap and coupling strip is made three-dimensional in order to further increase the stability of the connection.

The stability of the coupling strip itself can be increased in several ways. In one embodiment, the coupling strip is split into two parallel spaced arms in the longitudinal direction of the strip between the connections of the caps with the coupling strip. This embodiment stiffens the coupling strip against twisting and rotation and thus results in increased stability. If the outer edges of the arms are situated in the plane of the bottoms of the latch parts, the guidance of the band in the fitting machine will be improved.

In another embodiment, the coupling strip is made three-dimensional in the region in which the caps are connected with the coupling strip. Apertures (perforations) may also be provided in the coupling strip to reduce weight and for the engagement of aligning elements. Different designs of the coupling strip, e.g. the selection of the cross-sectional configuration of its arms, also make it possible to determine the flexibility, i.e., the degree of stiffness, of the entire band when it is rolled or wound as the finished fitting material. Broadened and raised portions can be provided on the coupling strip at predetermined locations, for example, between two latch parts to give the band a multidimensional design, and simultaneously to serve as band guiding elements for further processing of the latch assemblies in a tool of the fitting machine.

DESCRIPTION OF THE PREFERRED EMBODIMENTS

Figure 2:
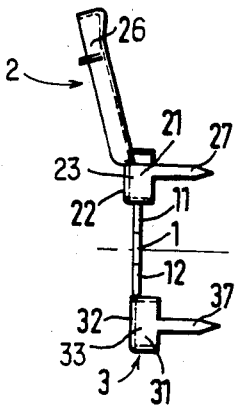
FIG. 2 is an end elevational view of the embodiment illustrated in FIG. 1.
Figure 1:
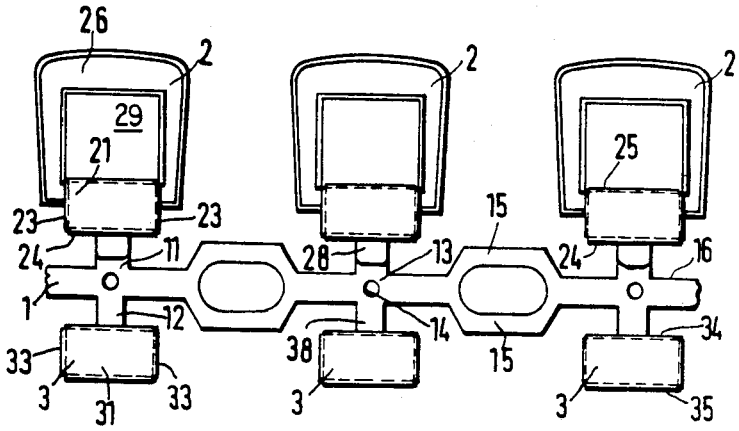
FIG. 1 is a side elevational view of a band of latch assemblies according to one preferred embodiment of the invention.

Referring to FIGS. 1 and 2, there is shown a band of latch assemblies according to a preferred embodiment of the invention. The band includes an elongated coupling strip 1, to which there are attached a series of latch assemblies (hasps) each comprising an upper latch part 2 and a lower latch part 3, as viewed in FIGS. 1 and 2. Each latch part 2 and 3 has an attachment member formed by a cap 21 (belonging to the upper latch part 2) and a cap 31 (belonging to the lower latch part 3). It is noted that the caps 21 and 31 need not be components of a latch assembly; they each may be a part of another attachment member. Also, it is within the scope of the invention to provide single-part latch assemblies on the coupling strip. As will be described in more detail later, at least one of the walls of each cap 21 and 31 is angled and connected with the coupling strip 1.

Each cap 21 has a front wall 22, two side walls 23, a bottom wall 24 oriented towards the respective cap 31 and a cover wall 25 facing away from the cap 31. Similarly, cap 31 has a front wall 32, two side walls 33, a bottom wall 34 oriented towards the cap 21 and a cover wall 35 facing away from the cap 21. The above identification of the several cap walls has been arbitrarily selected, taking into consideration the subsequent mounted position of the individual latch assemblies on the articles with which they will be used.

To the cap 21 belonging to each upper latch part 2 there is articulated a latching flap 26 provided with a large central opening 29 which, in service, when the latch assembly is in a closed position, is pivoted over the cap 31 belonging to the lower latch part 3 such that the lower cap 31 is received in the opening 29. It is to be understood that other types of closing flaps may be provided with a different type of attachment to the cap 21. Also, in order to urge the pivotal flap 26 into one or both end positions, spring elements may be accommodated in the cap 21.

As seen in FIG. 2, the side walls 23 and 33 of the respective caps 21 and 31 are extended to form pointed attachment prongs 27 and 37.

A tongue or tab 28 is stamped out of the bottom wall 24 of each cap 21 and is bent once (out of the plane of the bottom wall 24). Each tongue 28 of the upper latch parts 2 merges into the coupling strip 1 with the intermediary of a respective connecting web 11. Further, the front wall 32 of each cap 31 (belonging to the lower latch part 3) is extended towards the coupling strip 1 beyond the bottom wall 34 to form a tongue or tab 38 which merges into the coupling strip 1 with the intermediary of a connecting web 12. The tongue 38 is slightly angled. The connecting webs 11 and 12 provided as continuations of respective tongues 28 and 38 are coplanar with the coupling strip 1 and lie in the axis of symmetry of the respective upper and lower latch parts 2 and 3.

In a fitting machine (not shown), upper latch part 2 is severed along a line where the tongue 28 merges with the connecting web 11 so that tongue 28 remains fastened to the cap 21. The lower part 3, on the other hand, is severed immediately adjacent the plane of the bottom wall 34 so that the tongue 38 is separated from the cap 31. The bottom wall 34 of cap 31 is provided with a slit (not shown). When, in service, upper part 2 is latched to lower part 3, tongue 28 is guided in such slit to stabilize the latch assembly.

Figure 4:
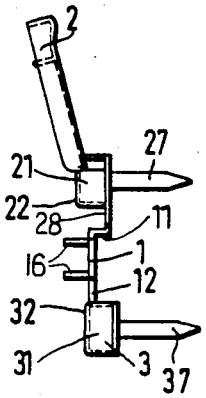
FIG. 4 is an end elevational view of the embodiment illustrated in FIG. 3.
Figure 3:
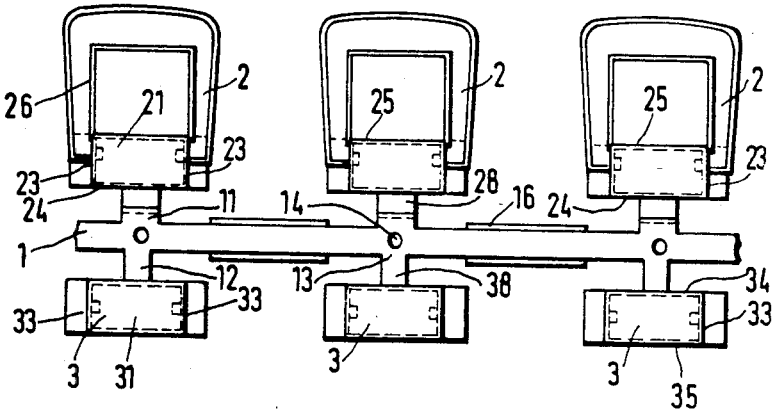
FIG. 3 is a side elevational view of a band of latch assemblies according to another preferred embodiment of the invention.

Turning now to the embodiment illustrated in FIGS. 3 and 4, the tongues 28 and 38 may be angled several times before they merge with the respective connecting web 11 or 12. Multiple angles or bends are particularly suitable if the associated cap should present a solid wall, for example, solid bottom walls 24 and 34 even along those portions which are covered when the latching assembly is in a closed, latching position. In order to provide a resistance to twisting, the coupling strip 1 can be made three-dimensional, with portions in different planes, by the provision of flanges 16 along its edges between regions 13 of the coupling strip 1. For stabilizing the connection, it is also feasible to provide the connecting webs 11 and 12 as well as the tongues 28 and 38 not in a planar but in a three-dimensional configuration, for example, by providing these components with flanges along their longitudinal edges.

Figure 6:
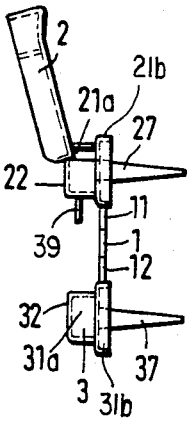
FIG. 6 is an end elevational view of the embodiment illustrated in FIG. 5.
Figure 5:
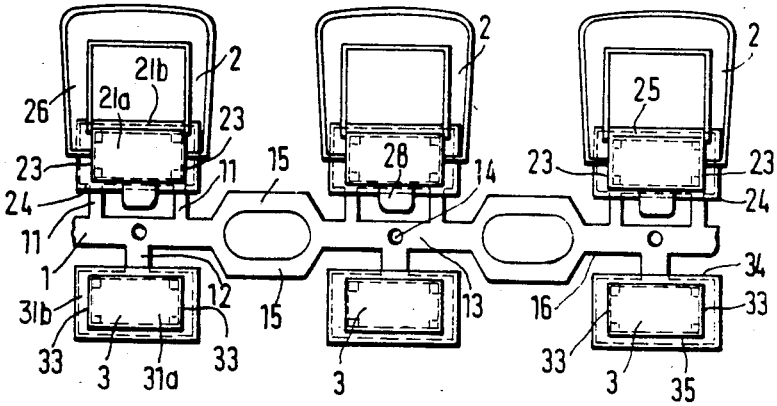
FIG. 5 is a side elevational view of a band of latch assemblies according to a further preferred embodiment of the invention.

In the embodiment shown in FIGS. 5 and 6, each attachment cap is assembled of two cap-shaped parts. Thus, each upper attachment cap includes a top cap-shaped part 21*a* secured in a conventional manner to a bottom cap-shaped part 21*b*. Each lower attachment cap is similarly assembled of a top cap-shaped part 31*a* secured to a bottom cap-shaped part 31*b*. Bottom cap-shaped parts 21*b* and 31*b* of the respective caps 21 and 31 are of the same material as and are integral with coupling strip 1 and connecting webs 11 and 12.

To stabilize the connection of upper and lower parts 2 and 3 of each latch assembly to coupling strip 1 a plurality of connecting webs 11 leading from the same cap 21 to coupling strip 1 can be provided as shown in FIGS. 5 and 6. In this case a tongue 39, connected with bottom wall 24 is provided as a guide member for latching engagement of upper and lower latch parts 2 and 3. Tongue 39 and connecting webs 11 can be placed in different planes.

Between the connections of connecting webs 11 and 12 to coupling strip 1 in region 13, coupling strip 1 is divided into two parallel spaced arms 15 for increasing its resistance to twisting.

It will be understood that the above description of the present invention is susceptible to various modifications, changes and adaptations and the same are intended to be comprehended within the meaning and range of equivalents of the appended claims.

What is claimed is:

1. A band of assemblies for use with a fitting machine which attaches each assembly to a respective article, said band comprising:

a common elongated coupling strip;

a plurality of connecting elements affixed to said coupling strip, said connecting elements being serially connected to said coupling strip and spaced from one another along said coupling strip;

a plurality of assemblies each having a cap-shaped attachment member including fastening means for attaching said attachment member to an article, each said cap-shaped attachment member having a wall facing said coupling strip, each said wall having a portion cut and bent therefrom to form a tongue, and each said tongue merging with a respective one of said connecting elements so that each said cup-shaped attachment member is connected to said coupling strip via a respective one of said connecting elements.

2. A band as defined in claim 1, wherein each said connecting element has at least two bends.

3. A band as defined in claim 1, wherein said coupling strip is divided into two parallel spaced arms between consecutive assemblies along said coupling strip.

4. A band as defined in claim 1, wherein said coupling strip has three-dimensional length portions between consecutive assemblies along said coupling strip.

5. A band as defined in claim 1, wherein each said assembly is a latch assembly including at least one latch part and said cap-shaped attachment member forms part of said latch part.

6. A band as defined in claim 1, wherein each said connecting element is three-dimensional.

7. A band as defined in claim 1, wherein each said assembly is a latch assembly having a first and a second latch part; further wherein each of said first and second latch parts includes a separate one of said cap-shaped attachment members and further wherein each said first and second latch part is connected to said coupling strip by a respective one of said cap-shaped attachment members via a respective one of said connecting elements.

8. A band as defined in claim 7, wherein the connecting elements associated with said first latch parts are disposed in a different plane than the connecting elements associated with said second latch parts.

9. A band as defined in claim 1, wherein each said cap-shaped attachment member has at least one wall including an angled portion connected integrally with said coupling strip.

10. A band as defined in claim 1 wherein each said assembly has a first and a second part, further wherein each of said first and second parts includes a separate one of said cap-shaped attachment members, further wherein each said first and second part is connected to said coupling strip by a respective one of said cap-shaped attachment members via a respective one of said connecting elements, and further wherein said coupling strip has two opposite longitudinal edges, said first and second parts of each said assembly being disposed adjacent a respective one of said opposite edges of said coupling strip and having a common plane of symmetry extending generally perpendicularly to said longitudinal edges, and each said tongue being centered with respect to said plane of symmetry.

11. A band of assemblies for use with a fitting machine which attaches each assembly to a respective article, said band comprising:

a common elongated coupling strip;

a plurality of connecting elements affixed to said coupling strip, said connecting element being serially connected to said coupling strip and spaced from one another along said coupling strip;

a plurality of assemblies each having a cap-shaped attachment member including fastening means for attaching said attachment member to an article, each said cap-shaped attachment member having a first wall facing said coupling strip and a second wall connected to one end of said first wall and being generally perpendicular to said first wall, said second wall of each said cap-shaped attachment member having an angularly bent tongue-shaped projection extending beyond said first wall and merging with a respective one of said connecting elements so that each said cap-shaped attachment member is connected to said coupling strip via a respective one of said connecting elements.

12. A band as defined in claim 11, wherein each said assembly has a first and a second part, further wherein each of said first and second parts includes a separate one of said cap-shaped attachment members, further wherein each said first and second part is connected to said coupling strip by a respective one of said cap-shaped attachment members via a respective one of said connecting elements, further wherein said coupling strip has two opposite longitudinal edges, said first and second parts of each said assembly being disposed adjacent a respective one of said opposite edges of said coupling strip and having a common plane of symmetry extending generally perpendicularly to said longitudinal edges, and each said angularly bent tongue-shaped projection being centered with respect to said plane of symmetry.

* * * * *